United States Patent [19]

Wich

[11] Patent Number: 4,949,540

[45] Date of Patent: Aug. 21, 1990

[54] HYDRAULIC ACTUATOR SYSTEM HAVING NON-CAVITATING FLOW EQUALIZER

[75] Inventor: Thomas Wich, Upland, Calif.

[73] Assignee: Bishamon Industries Corporation, Ontario, Calif.

[21] Appl. No.: 273,974

[22] Filed: Nov. 21, 1988

[51] Int. Cl.[5] ..... B66F 3/46; B66F 3/30

[52] U.S. Cl. ..... 60/387; 60/461; 91/171; 91/532; 137/99

[58] Field of Search ..... 91/171, 178, 517, 534, 91/532; 60/387, 426, 460, 461, 466; 137/99, 234.6

[56] References Cited

U.S. PATENT DOCUMENTS

| | | | |
|---|---|---|---|
| 2,632,472 | 3/1953 | Livers | 60/387 X |
| 4,034,649 | 7/1977 | Harvey et al. | 91/412 |
| 4,324,411 | 4/1982 | MacKenzie | 137/99 X |
| 4,335,894 | 6/1982 | Swanson | 280/42.23 |
| 4,337,959 | 7/1982 | Bettin et al. | 280/42.23 |
| 4,339,139 | 7/1982 | Swanson | 280/42.23 |
| 4,354,688 | 10/1982 | Swanson | 137/99 X |
| 4,437,484 | 3/1984 | Laing et al. | 137/99 |
| 4,475,714 | 10/1984 | Heiskell et al. | 254/891 X |
| 4,496,004 | 1/1985 | Frase et al. | 172/311 |
| 4,500,071 | 2/1985 | Bagwell et al. | 254/423 |
| 4,573,663 | 3/1986 | Nussbaum | 254/89 |

OTHER PUBLICATIONS

"Ben Pearson Tubemaster" brochure, 6 pp., Ben Pearson Tubemaster, Pine Bluff, AR no date.

"Challenger Excel Lifts" brochure, 2 pp., Challenger Lift Division, VBM Corporation, Louisville, KE, no date.

"Rotary Lift SPOA-84" brochure, 6 pp., Rotary Lift A Dover Industries Company, Memphis, TN, 1987.

"Bishamon Electro-Hydraulic Automobile Lift" brochure, 4 pp., Sugiyasu Iron Works Co., Ltd., Takahama, Japan, no date.

"Benwil Top Lift Model GPOR-7R" brochure, 4 pp., Benwill Industries, Inc., Carson, CA. 1988.

*Primary Examiner*—Robert E. Garrett
*Assistant Examiner*—George Kapsalas
*Attorney, Agent, or Firm*—Sheldon & Mak

[57] ABSTRACT

A hydraulic system having multiple actuators is provided with positive pressure flow equalization for both advancing and retracting movements of the system by means of first and second flow divider elements for each actuator. The flow divider elements are cross-coupled between the actuators, a controllable source of pressurized fluid and a reservoir. The flow divider elements are positive-displacement gear or vane pump units that are connected by a common shaft for coordinating fluid flow to the various actuators. Two or more of the actuators can be connected for lifting a load such as an automobile, the system being provided with safety latches at each actuator, the flow dividers not only coordinating the actuator movements during normal raising and lowering operation, but also preventing loss of synchronization of the actuators in case of engagement of a subset only of the latches. Synchronism is maintained even under negative loading because positive pressure is maintained between the dividers and each of the actuators, preventing cavitation.

18 Claims, 2 Drawing Sheets

HYDRAULIC ACTUATOR SYSTEM HAVING NON-CAVITATING FLOW EQUALIZER

BACKGROUND OF THE INVENTION

1. Field of the Invention

The present invention is related to hydraulic actuators, and more particularly to flow equalization in multiple actuator systems such as automobile lifts and the like.

In lifting large loads such as vehicles, it is desireable to arrange a plurality of lift units at opposite sides of the vehicle for providing virtually unobstructed access to the underside of the vehicle. A variety of means have been utilized for coordinating the operation of the lift units so as to maintain the vehicle level as it is raised and lowered, including the use of a single hydraulic actuator in one of the units, and a mechanical actuator in an opposite unit that is coupled to the hydraulic actuator such as by a chain.

2. Description of the Prior Art

A pair of hydraulic actuators can be synchronized by an interconnecting cable mechanism. Normally, the cable mechanism is only lightly loaded to the extent of an unbalanced loading of the actuators. However, in case of failure of one of the actuators, the cable mechanism must carry the full load of the failed member. U.S. Pat. No. 4,500,071 to Bagwell et al. also discloses the use of master and slave hydraulic actuators in opposing lift units, the master actuator having a dual-chamber cylinder, the slave actuator having a single-chamber cylinder.

It is also known to synchronize a multiple actuator system by the use of hydraulic flow dividers, as disclosed in U.S. Pat. No. 4,475,714 to Heiskell et al., wherein a trio of hydraulic lift actuators for a grand piano are synchronized by a triple gear-pump flow divider that is connected for providing equal volumes of flow under pressure to each of the actuators. Although the synchronization of multiple hydraulic actuators by hydraulic means avoids the problem of having a mechanical mechanism that connects the actuators, such synchronization is not always effective. In automobile lifts, for example, it is customary to provide each lift unit with a safety latch, the safety latches being released when it is desired to lower the load. If hydraulic pressure is released with fewer than all of the latches engaged, or if one of the latches inadvertently remains engaged during an attempted lowering of the vehicle, the actuators can lose synchronization as a result of cavitation of the hydraulic system, with disastrous consequences.

Thus there is a need for flow equalizing multiple hydraulic actuator system that is not subject to cavitation in the event that the equalizer is called open to prevent the retraction of one of its loaded actuators.

SUMMARY OF THE INVENTION

The present invention is directed to a hydraulic actuator system that meets this need by providing positive pressure flow equalization in both advancing and retracting movements of the system. The system includes a plurality of hydraulic actuators, each having a housing, a movable element in the housing, first and second ports in the housing for producing movement of the element in respective first and second directions in response to flow of fluid into the housing through the corresponding ports; flow divider means having a plurality of first and second fluid paths in number corresponding to the number of actuators, a volume displacement of fluid in each first fluid path being correlated with a proportional displacement of fluid in the corresponding second fluid path; means for connecting the first fluid path of each divider means in series with the first port of a corresponding actuator; and means for fluid connecting the second fluid path of each divider means in series with the second port of a different one of the actuators for synchronizing the movement of each of the actuators. The present invention advantageously provides positive fluid pressure resistance against asynchronous movement of any actuator in either direction. The actuators can each include a piston movable within a hydraulic cylinder that forms a first chamber connecting the first port, and a second chamber connecting the second port.

An important feature of the present invention is that the piston of each actuator can have a first effective area associated with the first chamber and a second effective area associated with the second chamber, the displacement correlation of the first and second fluid paths of the flow divider means being in direct proportional relation to the respective chamber effective areas to which each divider fluid path is connected. Thus the present invention advantageously can be used with hydraulic actuators that form a closed chamber on one side of each piston, and having a piston rod that protrudes from an opposite chamber of the actuator, opposite sides of the piston having different effective areas. Each fluid path of the flow divider means can be through a positive displacement pump element that includes a rotating member having an angular velocity proportional to a fluid flow rate of the path, the rotating members for each of the first and second fluid paths being shaft-connected for maintaining the respective flow rates in proportional relation. The proportional relationship can be predetermined according to a width ratio of the rotating members of each first and second fluid path pair. Each pump element can include a gear pump; also, each pump element can include a vane pump.

In a typical configuration of the present invention, there are two of the actuators; however, the invention provides that there can be at least three of the actuators. The system can further include a hydraulic reservoir, manifold means for connecting the first fluid paths of the divider means, pump means for selectively advancing the actuators by feeding hydraulic fluid from the reservoir into the manifold means, second manifold means for connecting the second fluid paths to the reservoir, and means for selectively retracting the actuators by dumping fluid from the manifold means directly to the reservoir. The pump means can have an electric fluid pump and a series-connected check valve. The dump means can include a normally closed solenoid-actuated or manual valve.

In an important aspect of the present invention, the system can include safety latch means for preventing movement of the actuator moveable elements in the second direction, the flow divider means preventing loss of synchronization of the actuators in case of engagement of the latch means with a subset only of the actuators. The safety latch means can have a latch mechanism that is coupled to at least one of the actuators for blocking movement of its movable element, and each of the actuators can have a latch mechanism of the latch means. The actuators are advantageously maintained in synchronism in the event of negative loading because the cross-coupled flow dividers operatively prevent movement of the other actuators by means of positive pressure between the flow dividers and the actuators.

The system can further include a plurality of vertically movable carriage means, each being operatively coupled to a corresponding actuator for lifting a load during movement of the actuator elements in the first direction. The load can be a vehicle such as an automobile, the carriage means being adapted for engaging the vehicle proximate opposite sides thereof for relatively unobstructed access to the underside of the lifted vehicle.

BRIEF DESCRIPTION OF THE DRAWINGS

These and other features, aspects, and advantages of the present invention will become better understood with reference to the following description, appended claims, and accompanying drawings where:

DETAILED DESCRIPTION OF THE PREFERRED EMBODIMENTS

Figure 3:
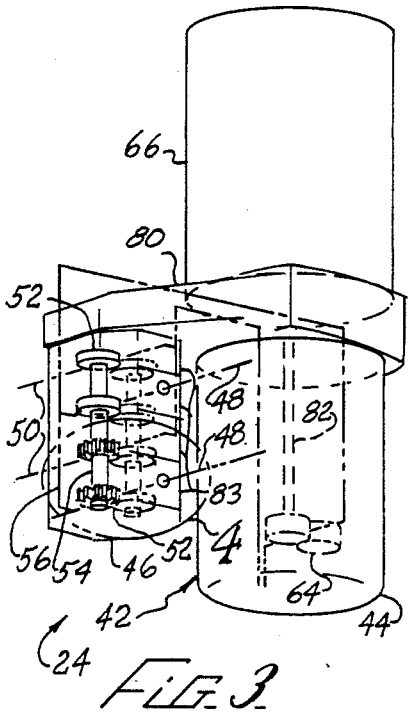
FIG. 3 is a bottom elevational perspective detail view of the system of FIG. 1 within a region 3 of FIG. 1.

The present invention is directed to an equalized multiple-actuator hydraulic system that is not subject to equalizer failure by cavitation when the system is subjected to asymmetrical negative loading. With reference to the drawings, and FIGS. 1–3 in particular, a hydraulic actuator system 10 includes a plurality of spaced apart lift units 12, designated 12*a* and 12*b* in FIG. 1. Each of the lift units 12 includes a carriage 14 that is vertically movable along an upstanding supporting column 16, the carriage 14 having a pair of arms 18 hingedly mounted thereto for movement in a horizontal plane, the arms 18 being adapted for supporting a load such as an automobile 20 from opposite sides thereof. A hydraulic actuator 22 is operatively connected between the column 16 and the carriage 14 for moving the carriage 14 upwardly along the column 16 of each lift unit 12, the actuators being designated 22*a* and 22*b* in FIG. 2. The lift unit 12*a* also includes a hydraulic power unit 24 that is connected for operating the actuators 22 as described herein, a course 26 being included between the lift units 12 for connecting the actuator 22*b* of the lift unit 12*b* to the power unit 24.

Figure 2:
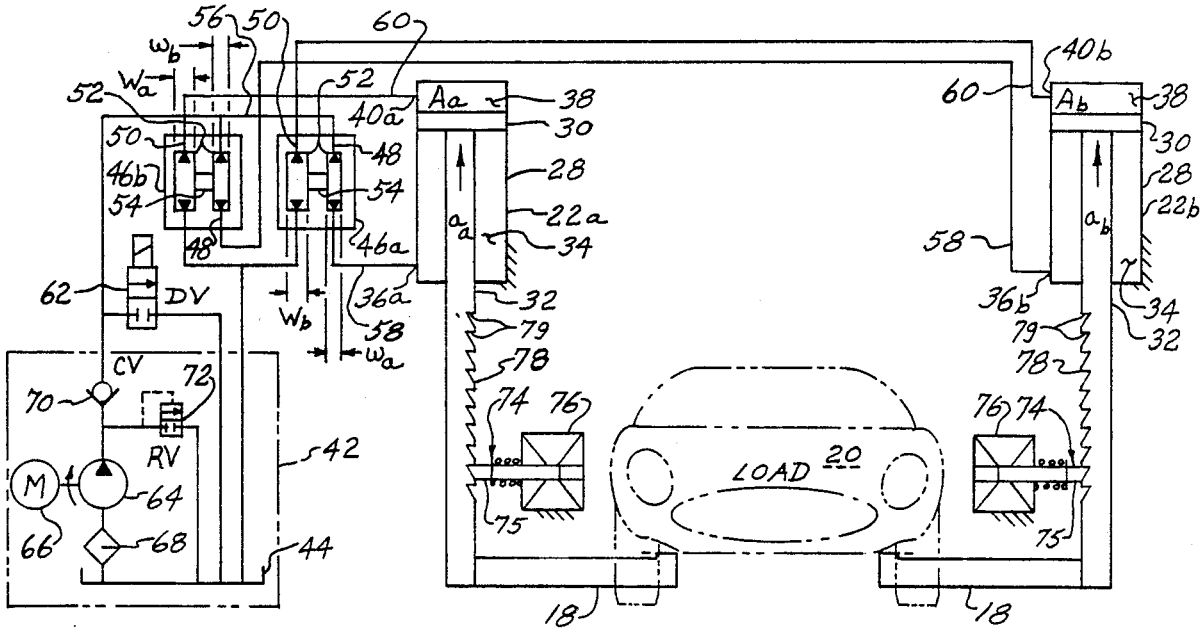
FIG. 2 is a functional schematic diagram of the system of FIG. 1.

With particular reference to FIG. 2, each actuator 22 includes a cylindrical housing 28 having a piston 30 sealingly slidable therein, the piston 30 being attached to an axially slidable rod 32 for coupling movement of the piston 30 external to the housing 28 in a conventional manner. The housing 28 thus forms with the piston 30 a first chamber 34 and an associated first port 36 for admitting fluid into the first chamber 34. Similarly, the housing 28 forms with the piston 30 a second chamber 38 and a second port 40 in fluid communication with the second chamber 38. In FIG. 2, the ports 36 and 40 are designated 36*a* and 40*a* for the actuator 22*a*, and 36*b* and 40*b*, respectively, for the actuator 22*b*.

The power unit 24 includes pump means 42 for pressure feeding hydraulic fluid from a reservoir 44 to the actuators 22. Between the pump means 42 and the actuators 22 are a plurality of flow divider means 46 for synchronizing the operation of the actuators 22 as described herein, the flow divider means being designated divider means 46*a* and 46*b* in FIG. 2. Each of the divider means 46 provides a primary fluid path 48 and a secondary fluid path 50, the fluid paths 48 and 50 each incorporating a positive-displacement bidirectional pump element 52, the elements 52 of each divider means 46 being synchronized by a connecting shaft 54 for proportionally coordinating the fluid flow volume in the fluid paths 48 and 50. The pump means 42 is fluid connected to the primary fluid path 48 of each divider means 46 by a manifold 56, each primary fluid path 48 being fluid connected to the first port 36 of a respective actuator 22 by a primary conduit 58 for moving the corresponding piston 30 in a first direction (lifting the load 20) as indicated by the arrows in FIG. 2. A secondary conduit 60 connects the secondary fluid path 50 of each divider means 46 to the second port 40 of an actuator 22 other than the actuator 22 to which the primary fluid path 48 is connected from that divider means 46, the secondary fluid path 50 being connected in series between the second port 40 and the reservoir 44. As shown in FIG. 2, the first fluid path 48 of the divider means 46*a* is in series with the first port 36*a* of the actuator 22*a;* but the second fluid path 50 of the divider means 46*a* is in series with the second port 40*b* of the actuator 22*b*. Similarly, the first fluid path 48 of the divider means 46*b* is in series with the first port 36*b* of the actuator 22*b;* but the second fluid path 50 of the divider means 46*b* is in series with the second port 40*a* of the actuator 22*a*. In response to the movement of the piston 30 of the actuator 22*a* in the first direction, fluid that is expelled from the second chamber 38 is directed from the second port 40*a* through the secondary fluid path 50 of the other divider means 46*b*, producing a corresponding flow in the primary fluid path 48 of that divider means 46*b* because of the interconnection of the pump elements 52 by the shaft 54. Thus the divider means 46*b* produces a corresponding movement of the piston 30 of the other actuator 22*b* because positive pressure is produced in the first chamber 34 of the actuator 22*b* in response to positive pressure in the second chamber 38 of the actuator 22*a*.

A solenoid-operated dump valve 62 is fluid connected between the manifold 56 and the reservoir 44 for permitting movement of the pistons 30 in a second direction opposite the first direction when it is desired to lower the load 20.

In FIG. 2, the actuators 22 are shown as having a piston area A and a rod area a, the first chamber 34 having an area of A−a, the second chamber 38 having the area A. In order to provide a proper volume correlation between the chambers 34 and 38, the divider means 46 are adapted for producing a flow in the secondary fluid path 50 that is a factor of A/(A−a) times the flow in the primary fluid path 48. Further, the divider means 46 can be configured for producing equal movements from actuators 22 having different areas. In particular, the actuator 22a is designated in FIG. 2 as having a piston area Aa and a rod area aa, while the actuator 22b has a piston area Ab and a rod area ab. Accordingly, and as further described below, the divider means 46a is configured to provide a flow in its secondary fluid path 50 that is a factor of Ab/(Aa−aa) times the flow in its primary fluid path 48; the divider means 46b is similarly configured to provide a flow in its secondary fluid path 50 that is a factor of Aa/(Ab−ab) times the flow in its primary fluid path 48. Thus the pump elements 52 of the divider means 46 are shown in FIG. 2 as having different widths, designated wa and wb for primary fluid paths 48 and Wa and Wb for the secondary fluid paths 50. This can also be accomplished with different diameters of the elements 52.

It will be appreciated by those skilled in the art that the system 10 can be loaded oppositely than is shown in FIG. 2, such that the connections of the reservoir 44 and the manifold 56 to the divider means 46 are reversed. In the reversed configuration, the secondary fluid path 50 meters fluid from the pump means 42 to the second chamber 38 of the associated actuator 22 for moving the rod 32 in a direction opposite the arrows in FIG. 2.

The pump means 42 includes a hydraulic pump 64 that is driven by a motor 66, the pump 64 being connected to receive fluid from the reservoir 44 through filter means 68, the fluid being directed under pressure through a check valve 70 to the manifold 56. A relief valve 72 is connected for limiting the hydraulic pressure to a safe level.

The system 10 also includes safety latch means for preventing inadvertent or accidental lowering of the load 20, the latch means including a solenoid-released or manual latch mechanism 74 that is operatively connected between the column 16 and the corresponding carriage 14 of each lift unit 12. As shown in the drawings, each latch mechanism 74 includes a pawl 75 coupled to an electric solenoid 76 that is fixed relative to the column 16, and a notched follower post 78 having a series of detent surfaces 79, the post 78 being fixed relative to the carriage 14. In normal operation, the system 10 raises the load 20 with the solenoids 76 deenergized, the latch mechanisms 74 ratcheting as the follower posts 78 move upwardly, the movement of the carriages being synchronized by the cross-coupled divider means 46. When the load 20 is at a desired elevation, the pump means 42 is deactivated; then, a small internal leakage of the divider means 46 allows the loaded carriages 14 to rest against the latch mechanisms 74. When it is desired to lower the load 20, the pump means 42 is momentarily actuated, unloading the latch mechanisms 74. Next, the solenoids 76 are activated, releasing the latch mechanisms 74 so that the load 20 may be lowered as far as desired by operation of the dump valve 62. In the event that hydraulic pressure is released from the dump valve 62 with fewer than all of the latch mechanisms 74 engaged, or if one of the latch mechanisms 74 inadvertently remains engaged during an attempted lowering of the load 20, the actuators 22 are maintained in synchronization by the cross-coupled fluid paths 48 and 50 of the divider means 46. The synchronization is maintained by positive hydraulic pressure that is developed in the second chamber 38 of any actuator 22 that is prevented by its latch mechanism 74 from being lowered when one or more of the other actuators 22 would otherwise permit the load 20 to be lowered as a result of release of pressure from the manifold 56. For example, if the actuator 22a is locked by its latch mechanism 74, the positive pressure is transmitted by the secondary conduit 60 to the secondary fluid path 50 of the divider means 46b, the positive pressure being coupled between the pump elements 52 by the shaft 54, producing a positive pressure in the primary fluid path 48 and the primary conduit 58 to the actuator 22b, the pressure being Wa/wb times the pressure in the secondary conduit 60 from the actuator 22a. The proportionate positive pressures are maintained according to the load applied to the actuator 22b for as long as the actuator 22a remains locked by its latch mechanism 74 and the actuator 22b remains unlocked, the actuator 22b slowly descending as a result of slight internal leakage in the divider means 46b. Ordinarily, the actuator 22b will become locked by its latch mechanism 74 when the internal leakage allows the pawl 75 to contact the next successive detent surface 79, at which point the positive hydraulic pressure subsides. Conversely, if the actuator 22b is locked while the actuator 22a is loaded, the divider means 46a couples positive pressure from the first chamber 34 of the actuator 22a through the primary conduit 58, thence through the secondary conduit 60 to the second chamber 38 of the actuator 22b. Accordingly, the present invention provides synchronization by positive hydraulic pressure during both directions of actuator movement such that the system 10 is not subject to loss of synchronization by cavitation from negative levels of hydraulic pressure in the event that one of the actuators 22 becomes negatively loaded.

Figure 1:
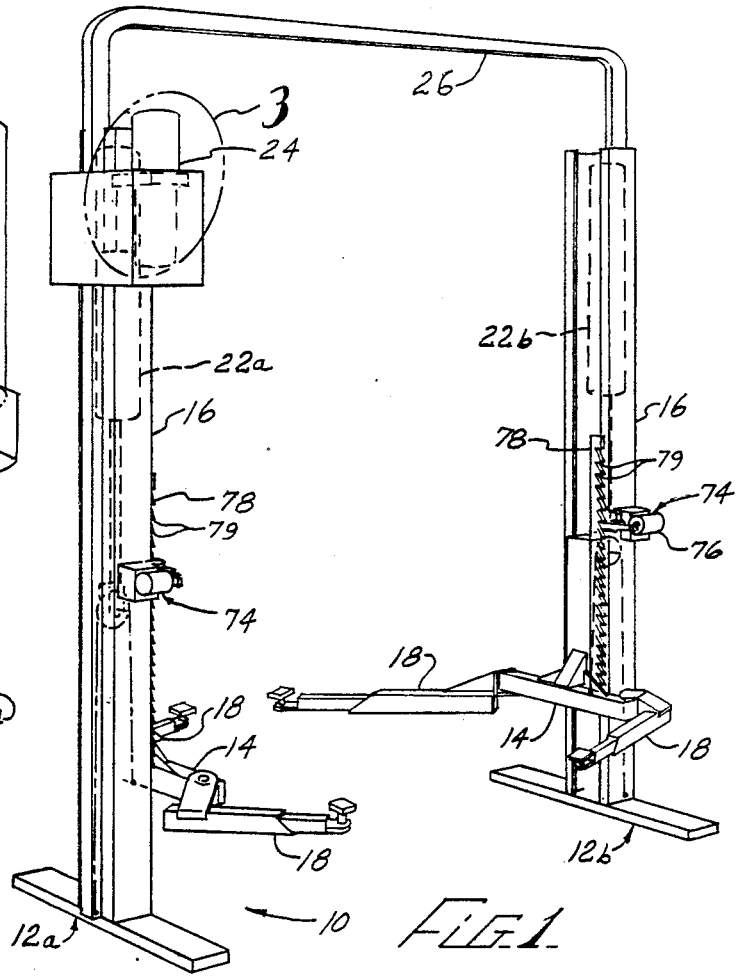
FIG. 1 is an oblique perspective elevational view of a hydraulic actuator system according to the present invention.
Figure 6:
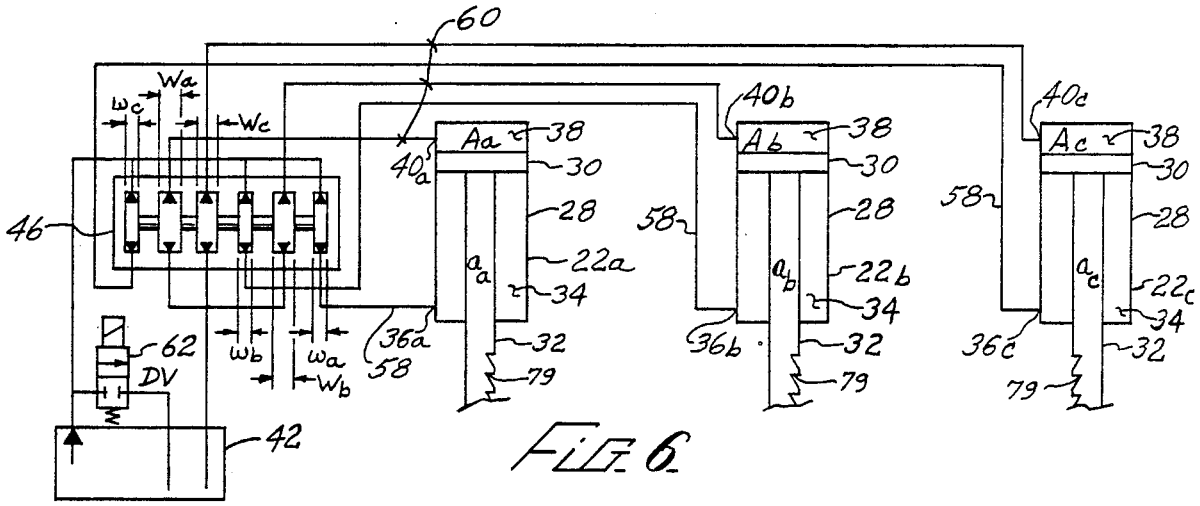
FIG. 6 is a functional schematic diagram showing another configuration of the system of FIG. 1.
Figure 5:
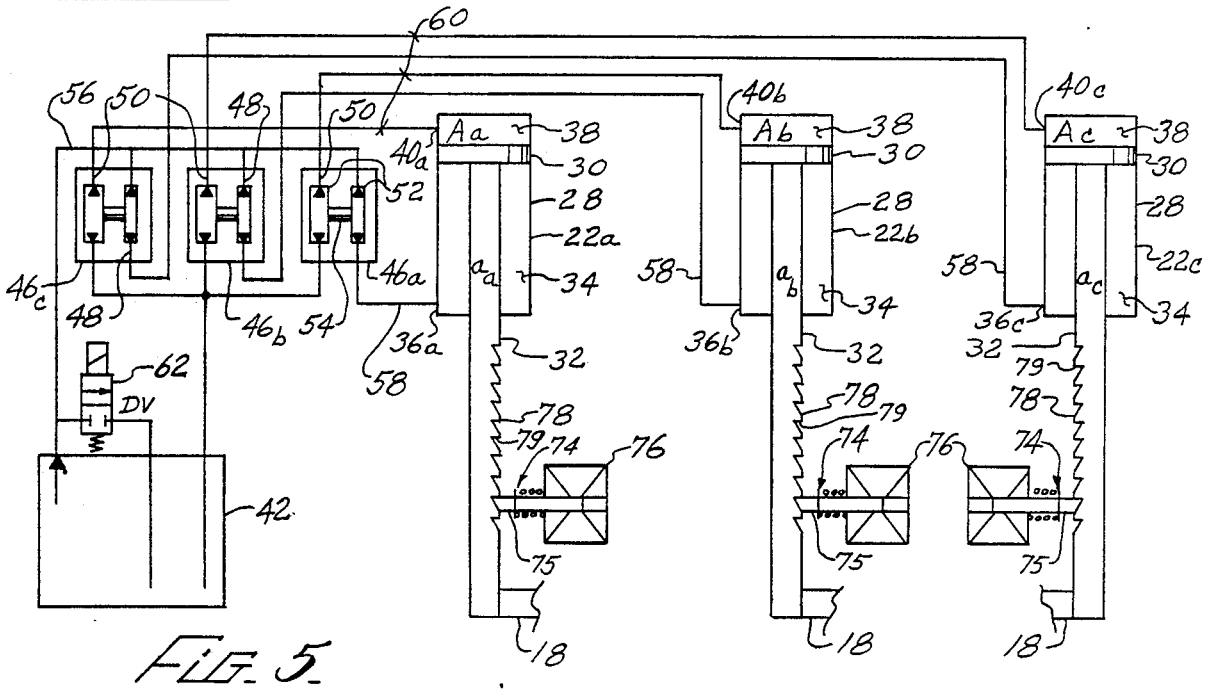
FIG. 5 is a functional schematic diagram as in FIG. 2, showing an alternative configuration of the system of FIG. 1.

Although the system 10 is configured with a pair of the actuators 22 as shown in FIGS. 1 and 2, additional actuators 22 can be accommodated as shown in FIGS. 5 and 6. As shown in FIG. 5, the system 10 includes a third actuator, designated 22c, and a third divider means 46, designated 46c, in addition to the other components shown in FIG. 2, with like designations referring to like components. A primary conduit 58 is connected to a first port 36c of the actuator 22c for fluid connecting the first chamber 34 thereof to a primary fluid path 48 of the divider means 46c, the primary fluid path 48 being series-connected to the manifold 56. A secondary conduit 60 connects a second port 40c of the actuator 22c for fluid communication from the second chamber 38 to the secondary fluid path 50 of the divider means 46b. Also, the secondary conduit 60 from the second port 40a of the actuator 22a is connected to the secondary fluid path 50 of the divider means 46c (instead of being connected to the secondary fluid path 50 of the divider means 46b as in FIG. 2). Thus each primary conduit 58 connects the primary fluid path 48 of a respective divider means 46 in series with the first port 36 of a corresponding actuator 22, and the secondary conduits 60 connect the secondary fluid path 50 of each divider means in series with the second port 40 of a different one of the actuators 22 for synchronizing the movement of each of the actuators 22. As configured in FIG. 5, the system 10 operates substantially as in FIG. 2, except that additional series connections are involved. For example, if only the actuator 22a is locked and the actuator 22b is downwardly loaded, the system 10 prevents downward movement of the actuator 22b by positive pressure in the second chamber 38 of the actuator 22a being coupled proportionally to the first chamber 34 of the actuator 22c by the divider means 46c, thence from the second chamber 38 of the actuator 22c to the first chamber 34 of the actuator 22b by the divider means 46b. If the actuator 22c is also loaded, the pressure in the second chamber 38 of the actuator 22a as well as the pressure in the first chamber 34 of the actuator 22c is increased correspondingly.

In a further variation of the system 10 according to the present invention, the shaft 54 can be extended to connect all of the pump elements 52 of the divider means 46 as shown in FIG. 6. Thus the divider means 46 forms a single unit with the synchronization of any two of the actuators 22 being obtained by positive pressure from only two of the pump elements 52. This is because the primary fluid path 48 that is series-connected to any actuator 22 is directly connected by the shaft 54 to the secondary fluid path 50 that is associated with each of the other actuators 22. Further, the hydraulic pressure needed for equalizing the system 10 in this variation is reduced in that the loading is not accumulated from unit to unit as in the variation of FIG. 5. However, it should be noted that the system 10 will hydraulically lock up if the flow ratios of the flow divider means 46 do not match the area ratios of the actuators 22. In the variation of FIG. 5 wherein the individual flow divider means 46 are not connected together with the shaft 54 in common, the system 10 is less rigid and will therefore be more forgiving of differences due to a stack up of tolerances. In other words, it is expected that for a given discrepancy in the area ratios of the actuators 22 from the flow ratios of the divider means 46, a higher rate of internal leakage in the divider means 46 must be tolerated in the variation of FIG. 6 than in the variation of FIG. 5.

As shown in FIG. 3, the power unit 24 can form an integral unit that includes the divider means 46 and the pump means 42. The motor 66 and the reservoir 44 can be mounted to opposite sides of a housing 80, an armature shaft 82 of the motor 66 extending into the reservoir 44 for driving the pump 64. The divider means 46 is mounted to the housing 80 to one side of the reservoir 44, each of the pump elements 52 forming a module 83, the modules 83 being endwise stacked against the housing 80. The manifold 56, and passages for the primary and secondary fluid paths 48 and 50 are formed integrally with the modules 83 and the housing 80, which also locates the dump valve 62 (not shown), the check valve 70 (not shown), and the relief valve 72 (not shown). Each pump element 52 is configured as a gear pump, the elements 52 being identically configured in a plane perpendicular to the shaft 54. Each pump element 52 (and module 83) that provides a primary fluid path 48 is configured with a width w, designated wa and wb in FIG. 2. The other pump elements 52 (and modules 83) for the secondary fluid paths 50 are configured with a width W, designated Wa and Wb in FIG. 2 for coordinating the respective fluid flow volumes in proportion to the areas of the connected first and second chambers 34 and 38.

Figure 4:
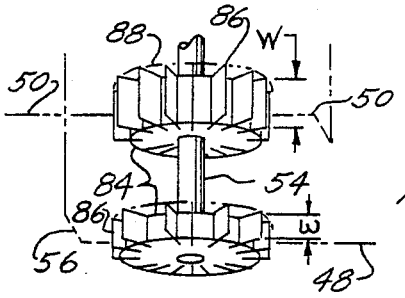
FIG. 4 is a bottom elevational perspective detail view within region 4 in FIG. 3, showing an alternative configuration of the system of FIG. 1.

With further reference to FIG. 4, the pump elements 52 of the divider means 46 are shown in an alternative configuration as positive-displacement vane pumps, each having a slotted rotor 84 that carries radially slidable vanes 86 that sealingly contact a cavity 88 of the divider means 46. Each cavity 88 is shaped to provide an angularly changing radial clearance with the rotor 84 proximate the respective fluid paths 48 and 50, but otherwise a constant clearance, for compatibility with incompressible hydraulic fluid. The elements 52 shown in FIG. 4 are identically configured in a plane perpendicular to the shaft 54 and have widths W and w as indicated in FIGS. 2 and 6.

The system 10 of the present invention thus advantageously provides effective equalization of the actuators 22, particularly under variable loading of the actuators 22 such that under some conditions the loading is in the same direction, while under other conditions the loading of at least some of the actuators is in opposite directions.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. A hydraulic actuator system comprising:

(a) a plurality of hydraulic actuators, each actuator comprising:
  (i) a housing;
  (ii) a movable piston in the housing, the piston forming first and second chambers with the housing and having a first effective area associated with the first chamber and a second effective area associated with the second chamber;
  (iii) a first port in the housing in fluid communication with the first chamber for producing movement of the element in a first direction in response to flow of fluid into the housing; and
  (iv) a second port in the housing in fluid communication with the second chamber for producing movement of the element in a second direction in response to flow of fluid therethrough into the housing;

(b) flow divider means having a plurality of first and second fluid paths, the number of first and second fluid paths corresponding to the number of actuators, each fluid path of the flow divider means being through a positive displacement pump element, each pump element comprising a rotating member that moves with an angular velocity that is proportional to the volume rate of fluid displacement of the respective fluid path, the rotating member for each first fluid path being shaft-connected to the rotating member of the corresponding second fluid path whereby a volume displacement of fluid in each first fluid path is directly proportional to the displacement of fluid in the corresponding second fluid path, in relation to the respective chamber effective areas to which each divider fluid path is connected;

(c) means for fluid connecting the first fluid path of each divider means in series with the first port of a corresponding actuator;

(d) means for fluid connecting the second fluid path of each divider means in series with the second port of a different one of the actuators for correlating the movement of each of the actuators with the movement of the other actuators;

(e) a hydraulic reservoir;

(f) manifold means for parallel fluid-connecting the first fluid paths of the divider means;

(g) pump means for selectively pressure feeding hydraulic fluid from the reservoir to the manifold means for advancing the actuators;

(h) means for fluid-connecting the second fluid paths of the divider means to the reservoir;

(i) dump means for selectively permitting the fluid to flow from the manifold means to the reservoir for retracting the actuators;

(j) a plurality of vertically movable carriage means, each carriage means being operatively coupled to a corresponding actuator for lifting a load, the load being lifted during movement of the actuator elements in the first direction; and (k) safety latch means for preventing movement of the carriage means in a direction lowering the load, comprising for each carriage means a latch mechanism operatively coupled thereto whereby a volume of fluid from the first port of each of the actuators is operatively cross-connected through the flow divider means to the second port of another of the actuators.

2. A hydraulic actuator system comprising:

(a) a plurality of hydraulic actuators, each actuator comprising:

(i) a housing;

(ii) a movable element in the housing;

(iii) a first port in the housing for producing movement of the element in a first direction in response to flow of fluid into the housing; and (iv) a second port in the housing for producing movement of the element in a second direction in response to flow of fluid therethrough into the housing;

(b) flow divider means having a plurality of first and second fluid paths whereby a volume displacement of fluid in each first fluid path is correlated with a proportionate displacement of fluid in the corresponding second fluid path, the number of first and second fluid paths corresponding to the number of actuators;

(c) means for fluid connecting the first fluid path of each divider means in series with the first port of a corresponding actuator; and (d) means for fluid connecting the second fluid path of each divider means in series with the second port of a different one of the actuators for correlating the movement of each of the actuators with the movement of the other actuators, whereby a volume of fluid from the first port of each of the actuators is operatively cross-connected through the flow divider means to the second port of another of the actuators.

3. The apparatus of claim 1 wherein the actuators each comprise a hydraulic cylinder having a piston movable therein, the cylinder forming a first chamber in fluid communication with the first port, and a second chamber in fluid communication with the second port.

4. The apparatus of claim 3 wherein the piston has a first effective area associated with the first chamber, and a second effective area associated with the second chamber, and the displacement correlation of the first and second fluid paths is in direct proportional relation to the respective chamber effective areas to which each divider fluid path is connected.

5. The apparatus of claim 4 wherein each fluid path of the flow divider means is through a positive displacement pump element, each pump element comprising a rotating member that moves with an angular velocity that is proportional to the volume rate of fluid displacement of the element, the rotating member for each first fluid path being shaft-connected to the rotating member of the corresponding second fluid path, the proportional displacement correlation being produced according to a width ratio of the rotating members.

6. The apparatus of claim 1 wherein each fluid path of the flow divider means is through a positive displacement pump element, each pump element comprising a rotating member that moves with an angular velocity that is proportional to the volume rate of fluid displacement of the element, the rotating member for each first fluid path being shaft-connected to the rotating member of the corresponding second fluid path.

7. The apparatus of claim 6 wherein each pump element comprises a gear pump.

8. The apparatus of claim 6 wherein each pump element comprises a vane pump.

9. The apparatus of claim 1 having two of the actuators.

10. The apparatus of claim 2 having at least three of the actuators.

11. The apparatus of claim 2 further comprising:

(a) a hydraulic reservoir;

(b) manifold means for parallel fluid-connecting the first fluid paths of the divider means;

(c) pump means for selectively pressure feeding hydraulic fluid from the reservoir to the manifold means for advancing the actuators;

(d) means for fluid-connecting the second fluid paths of the divider means to the reservoir; and (e) dump means for selectively permitting the fluid to flow from the manifold means to the reservoir for retracting the actuators.

12. The apparatus of claim 11 wherein the pump means comprises an electric motor-driven positive displacement pump, and a check valve connected in series with the pump.

13. The apparatus of claim 11 wherein the dump means comprises a normally closed, solenoid-actuated valve fluid connected in series between the first manifold means and the reservoir.

14. The apparatus of claim 1 further comprising safety latch means for preventing the movement of each movable element in the second direction.

15. The apparatus of claim 14 wherein the safety latch means comprises a latch mechanism operatively coupled to at least one of the actuators for blocking movement of the element thereof.

16. The apparatus of claim 15 wherein each of the actuators has an associated latch mechanism of the safety latch means.

17. The apparatus of claim 2 further comprising a plurality of vertically movable carriage means, each carriage means being operatively coupled to a corresponding actuator for lifting a load, the load being lifted during movement of the actuator elements in the first direction.

18. The apparatus of claim 17 further comprising safety latch means for preventing movement of the carriage means in a direction lowering the load, comprising for each carriage means a latch mechanism operatively coupled thereto.

* * * * *